US010765201B2

(12) United States Patent
Lin

(10) Patent No.: US 10,765,201 B2
(45) Date of Patent: Sep. 8, 2020

(54) WORKSTATION WITH HEIGHT ADJUSTABLE DESK

(71) Applicants: Yi-Chen Tseng, Taichung (TW); HI-MAX INNOVATION CO., LTD., Taichung (TW)

(72) Inventor: Jhih-Fan Lin, Taichung (TW)

(73) Assignee: Y-Chen Tseng, Taichung (TW)

( * ) Notice: Subject to any disclaimer, the term of this patent is extended or adjusted under 35 U.S.C. 154(b) by 83 days.

(21) Appl. No.: 16/226,107

(22) Filed: Dec. 19, 2018

(65) Prior Publication Data

US 2020/0196749 A1 Jun. 25, 2020

(51) Int. Cl.
*A47B 21/02* (2006.01)

(52) U.S. Cl.
CPC ..... *A47B 21/02* (2013.01); *A47B 2200/004* (2013.01); *A47B 2200/0066* (2013.01)

(58) Field of Classification Search
CPC ..... A47B 21/02; A47B 2200/004; A47B 2200/0066
USPC ..... 108/147, 20, 50.01, 50.02; 312/223.3, 312/194–196, 312, 306, 319.5–319.8
See application file for complete search history.

(56) References Cited

U.S. PATENT DOCUMENTS 335,432 A * 2/1886 Danzell
1,243,750 A * 10/1917 Miller ..... A47B 9/04 108/147
4,651,652 A * 3/1987 Wyckoff ..... A47B 9/12 108/147
4,790,611 A * 12/1988 Craner ..... A47B 57/00 108/147
4,969,403 A * 11/1990 Schwartz ..... A47B 5/00 108/147
5,083,514 A * 1/1992 Schwartz ..... A47B 5/00 108/108
6,021,722 A * 2/2000 Raycraft ..... A47B 9/10 108/147
7,743,716 B1 * 6/2010 Burka ..... A47B 77/02 108/147
10,034,538 B1 * 7/2018 Masters ..... A47B 9/10
10,561,233 B1 * 2/2020 Lin ..... A47B 9/12

FOREIGN PATENT DOCUMENTS

EP 2946689 * 11/2015

OTHER PUBLICATIONS

KR2007103914 Lim abstract and figure (Year: 2007).*
CN106419062 Cui et al figure and abstract (Year: 2017).*

* cited by examiner

*Primary Examiner* — Janet M Wilkens
(74) *Attorney, Agent, or Firm* — Wang Law Firm, Inc.

(57) ABSTRACT

A workstation includes a partition unit to form a workspace, in which a desk board, two lifting mechanisms are provided. Each of the lifting mechanisms has a linkage set and a movable member connected to the linkage set. The linkage sets are moved by one or more motor, and the movable member is connected to the desk board. The motor moves the linkage sets so as to lift and lower the desk board.

9 Claims, 8 Drawing Sheets

WORKSTATION WITH HEIGHT ADJUSTABLE DESK

BACKGROUND OF THE INVENTION

1. Technical Field

The present invention relates to office furniture, and more particularly to a workstation with a powered height adjustable desk.

2. Description of Related Art

Typically, a conventional workstation for office has a partition unit and a desk. The partition unit usually has three partitions to enclose a workspace, and the desk is provided in the workspace. Precisely, the partitions include a front member and two lateral members connected to opposite ends of the front member. The desk has a desk board fixed to the partitions. A drawback of such workstation is that a height of the desk board is fixed after the workstation is set.

An improved workstation has a partition unit and a height adjustable desk provided in a workspace of the partition unit. In such workstation the partition unit and the height adjustable desk are two independent elements without any connection. Furthermore, the height adjustable desk has at least two legs in the workspace, which narrows the space under the desk board.

BRIEF SUMMARY OF THE INVENTION

In view of the above, the primary objective of the present invention is to provide a workstation, which is equipped with a height adjustable desk.

The secondary objective of the present invention is to provide a workstation, which has powered lifting devices to lift and lower the desk board, and the lifting devices are fixed to the partitions to enlarge the space under the desk board.

In order to achieve the objective of the present invention, a workstation includes a front partition member having a first end and a second end opposite to the first end; a first wall member and a second wall member connected to the first end and the second end of the front partition member to enclose a workspace; a desk board provided in the workspace; two lifting apparatuses connected to a bottom of the desk board, each of which has a first tubular member, a second tubular member, and a lifting device, wherein the second tubular members are fixed to the first wall member and the second wall member respectively, and each of the first tubular members has an end fitted to the second tubular member and an opposite end connected to the desk board; the lifting device is received in the first and the second tubular members to move the first tubular member relative to the second tubular member; and a driving device connected to the lifting apparatuses to drive the lifting apparatuses.

The driving device is operated to drive the first tubular members to move upwards and downward so as to lift and lower the desk board.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
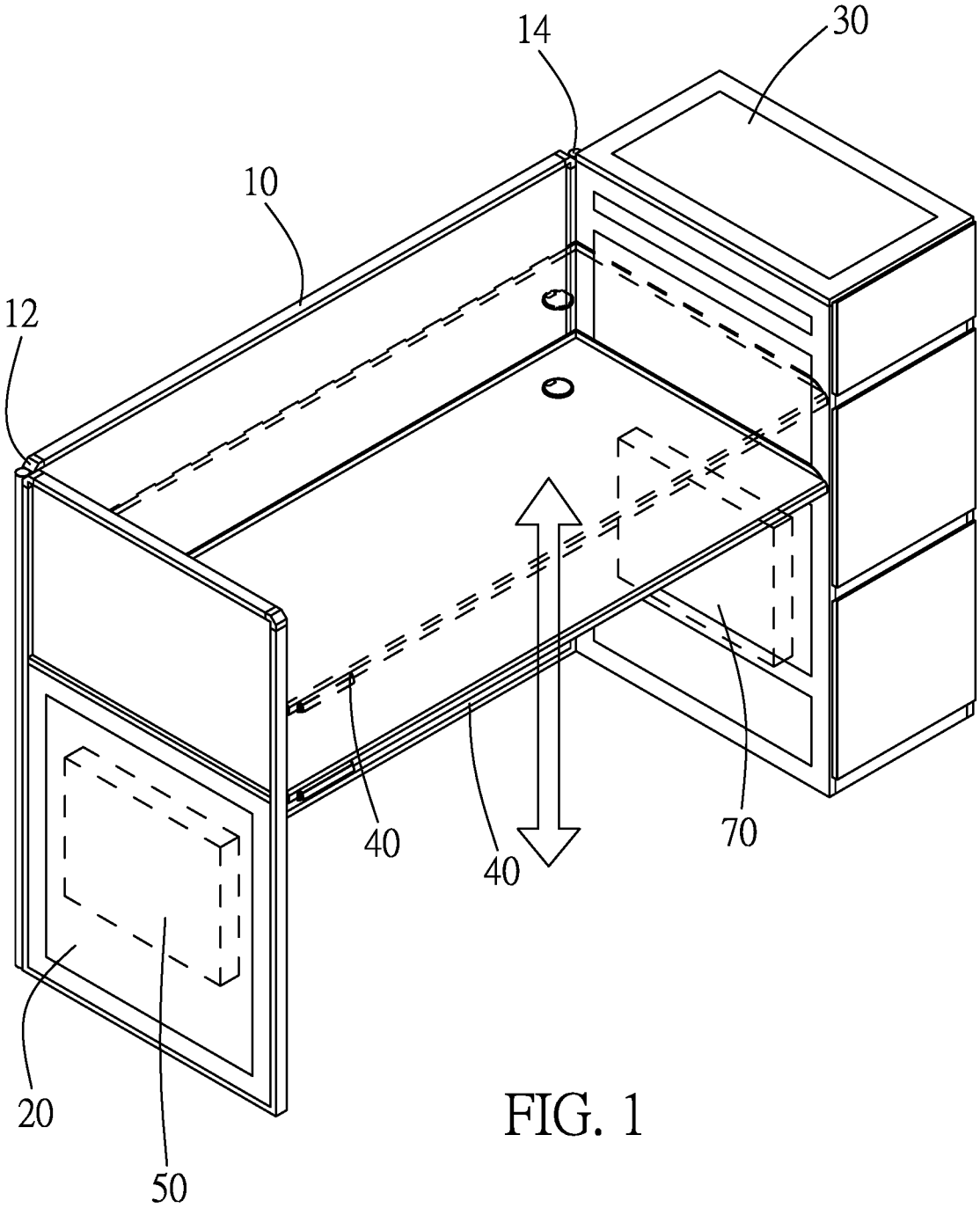
FIG. 1 is a perspective view of a first preferred embodiment of the present invention.
Figure 2:
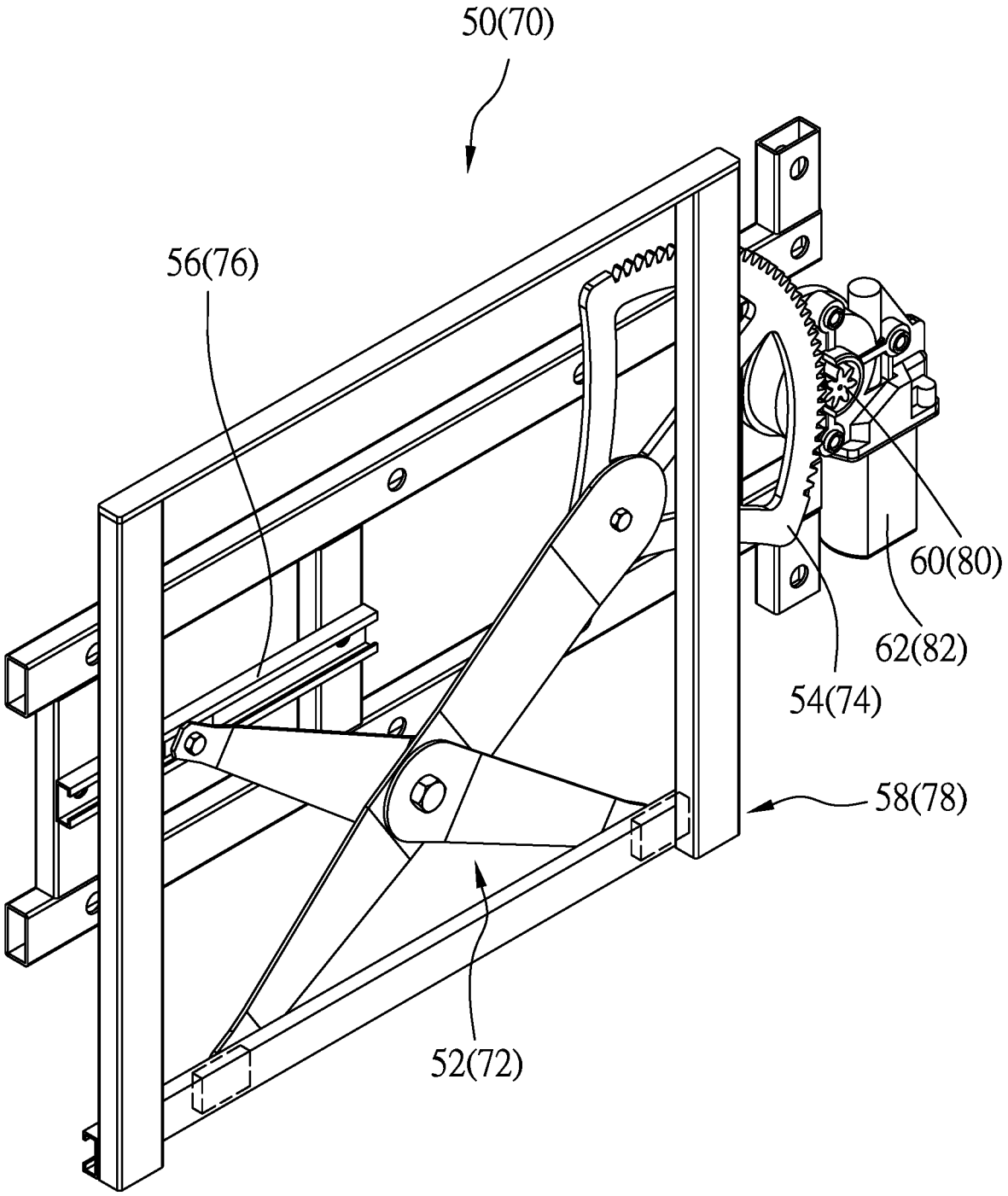
FIG. 2 is a perspective view of the first preferred embodiment of the present invention, showing the first and the second lifting mechanisms.

FIG. 1 shows a workstation 1 of the first preferred embodiment of the present invention, including a front partition member 10, a first wall member 20, and a second wall member 30. The front partition member 10 has a first end 12 and a second end 14 opposite to the first end 12. The first wall member 20 is connected to the first end 12 of the front partition member 10 while the second wall member 30 is connected to the second end 14. The first and the second wall members 20 and 30 are perpendicular to the front partition member 10 to enclose a workspace therewithin. In the first preferred embodiment, the front partition member 10 and the first wall member 20 are two boards, and the second wall member 30 is a cabinet.

The workstation 1 further includes a desk board 40, a first lifting mechanism 50, and a second lifting mechanism 70, all of which are provided in the workspace. The first lifting mechanism 50 is fixed to the first wall member 20, and the second lifting mechanism 70 is fixed to the second wall member 30. The first and the second lifting mechanisms 50, 70 are operated to lift and lower the desk board 40.

The first lifting mechanism 50 includes a first linkage set 52, a first gear member 54, a first rail 56, a first movable member 58, a first driving gear 60, and a first motor 62. The first rail 56 is fixed to the first wall member 20. The first linkage set 52 includes a main linkage and two support linkages, wherein both the support linkages have ends pivoted on a middle section of the main linkage. A distal end of one of the support linkages is pivoted with a slider, and the slider engages the first rail 56 to move along the rail 56. An end of the main linkage is connected to the first gear member 54. The driving gear 60 is connected to the first motor 62 and engages the first gear member 54.

The same as the first lifting mechanism 50, the second lifting mechanism 70 includes a second linkage set 72, a second gear member 74, a second rail 76, a second movable member 78, a second driving gear 80, and a second motor 82. The second rail 76 is fixed to the second wall member 20. The second linkage set 72 includes a main linkage and two support linkages, wherein both the support linkages have ends pivoted on a middle section of the main linkage. A distal end of one of the support linkages is pivoted with a slider, and the slider engages the second rail 76 to move along the rail 76. An end of the main linkage is connected to the second gear member 74. The driving gear 80 is connected to the second motor 82 and engages the second gear member 74.

Figure 3:
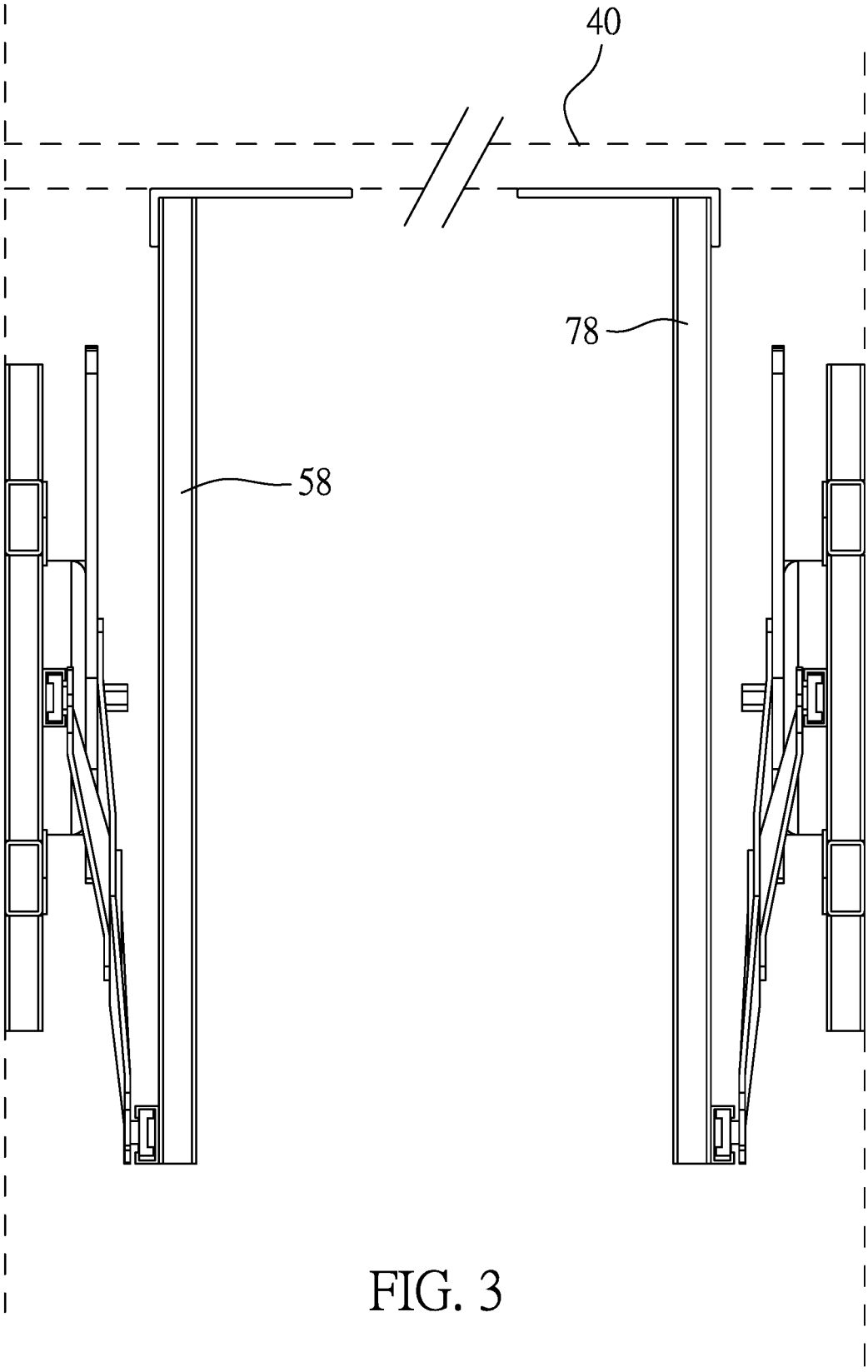
FIG. 3 is a lateral view of the first preferred embodiment of the present invention, showing the first and the second lifting mechanisms and the desk board.

As shown in FIG. 3, tops of the first movable member 58 and the second movable member 78 are connected to the desk board 40.

Figure 4:
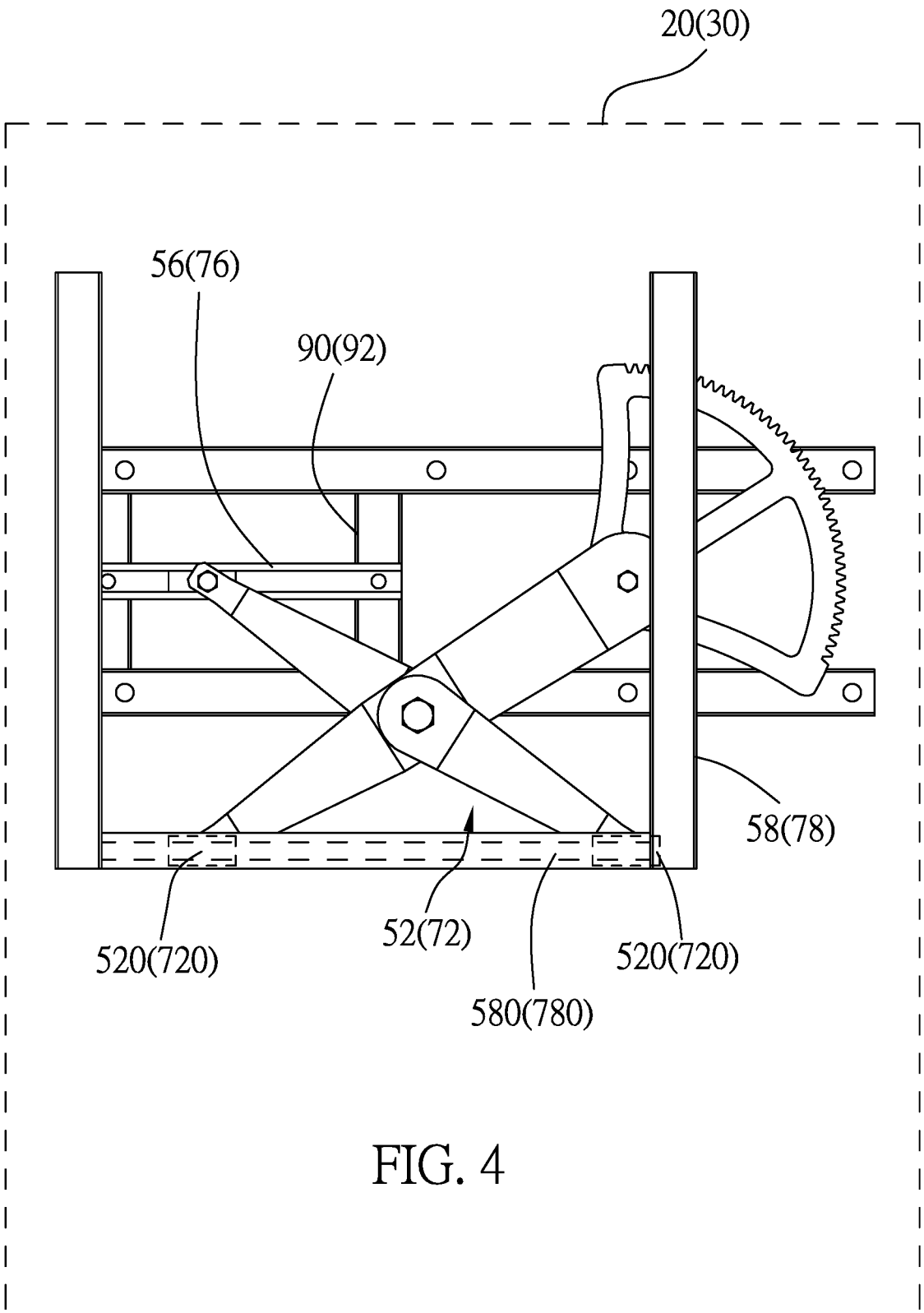
FIG. 4 is a front view of the first preferred embodiment of the present invention, showing the first and the second lifting mechanisms fixed to the first and the second wall members.

As shown in FIG. 4, the other end of the main linkage and a distal end of the other support linkage of the linkage set 52 are slidably to the first movable member 58. In the present preferred embodiment, the first movable member 58 is provided with a first guiding rail 580. Each of the main linkage and the support linkage of the linkage set 52 is pivoted with a slider, and the sliders engage the first guiding rail 580 to move along it. The second movable member 78 is provided with a second guiding rail 780. Each of the main linkage and the support linkage of the linkage set 72 is pivoted with a slider, and the sliders engage the second guiding rail 780 to move along it.

The workstation further includes a first frame 90 fixed to the first wall member 20 and a second frame 92 fixed to the second wall member 30. The first rail 56 is fixed to the first frame 90, and the second rail 76 is fixed to the second frame 92.

Figure 5:
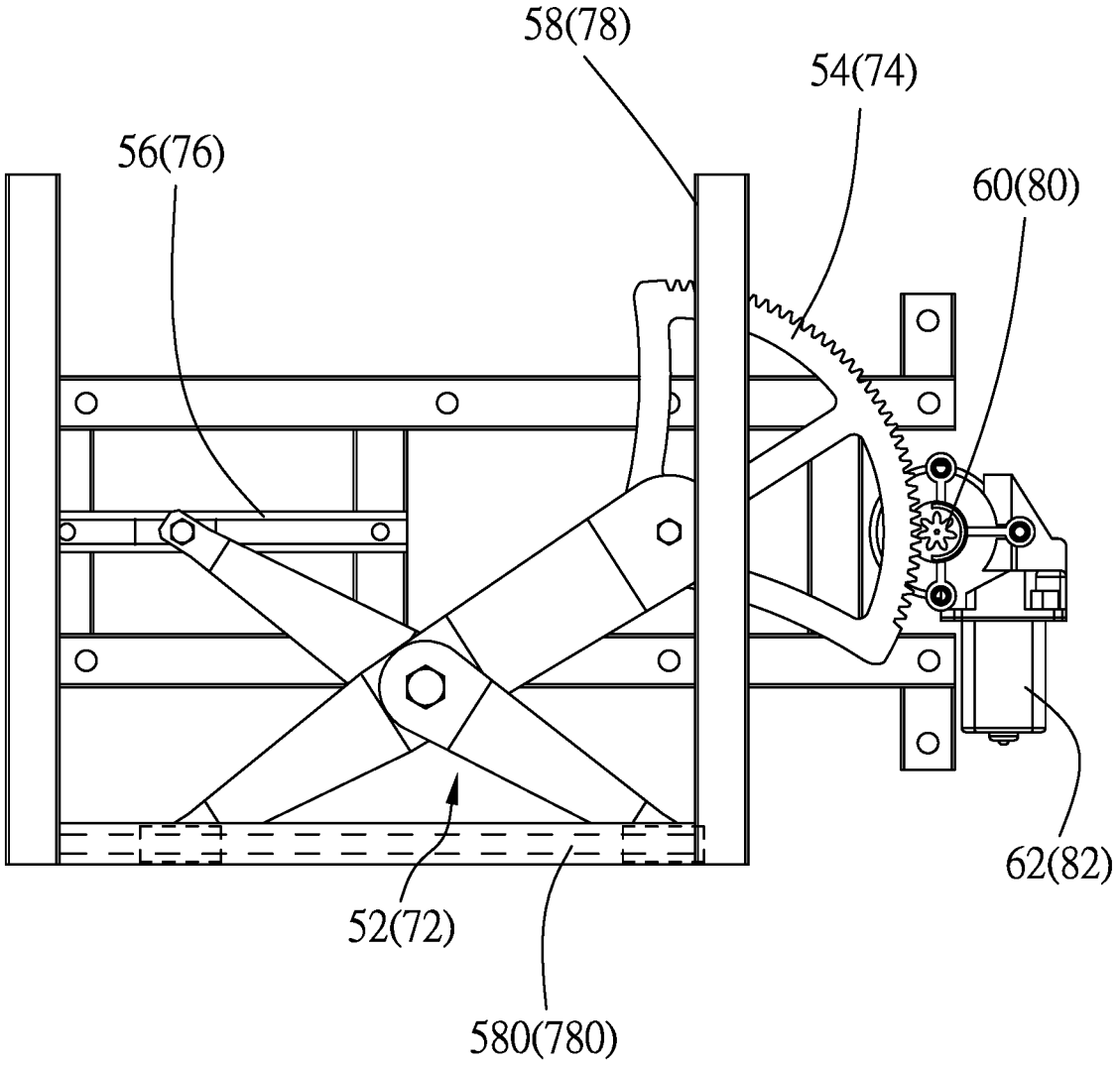
FIG. 5 is a front view of the first preferred embodiment of the present invention, showing the first and the second lifting mechanisms connected to the driving gear and the motor.
Figure 6:
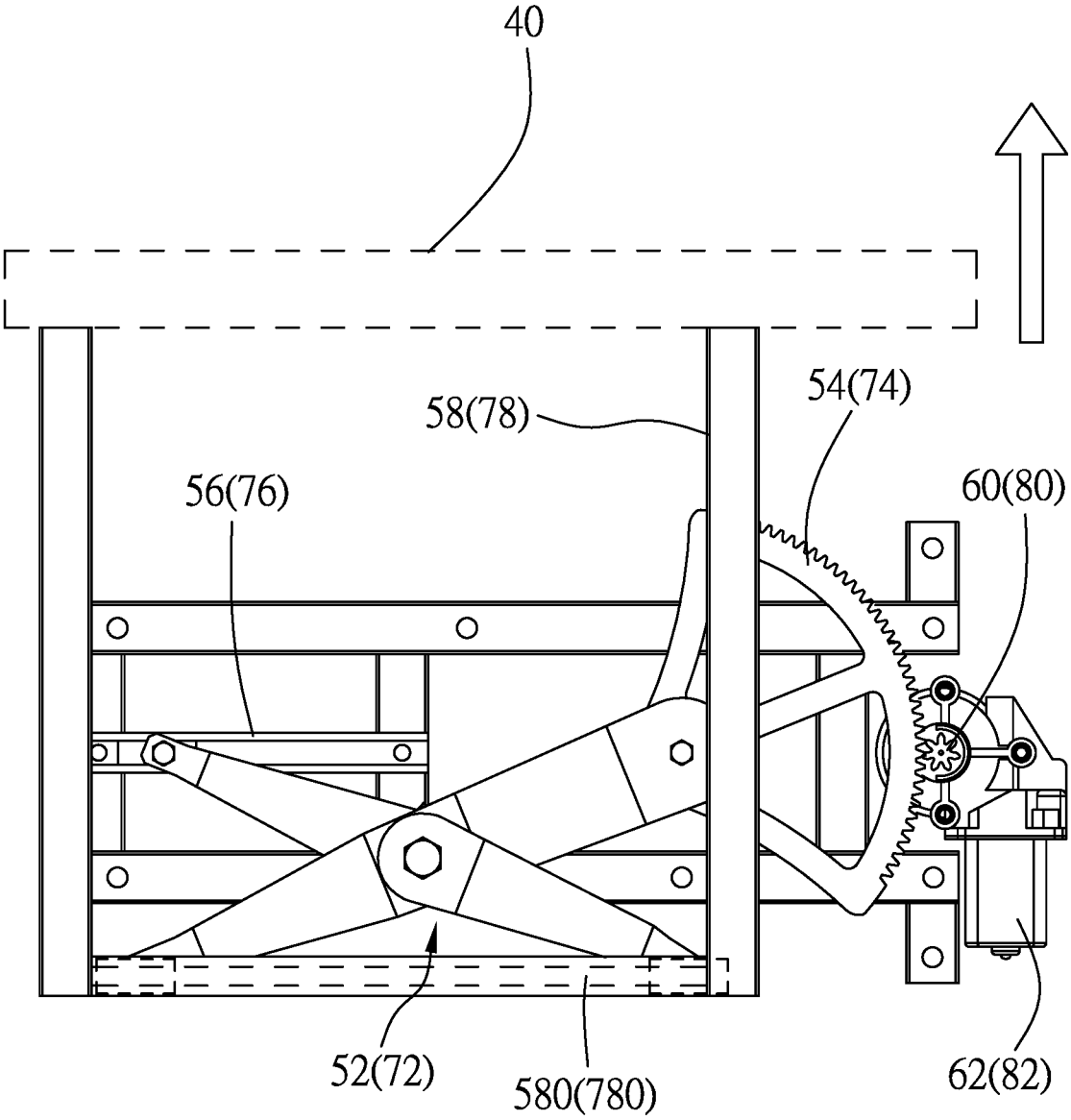
FIG. 6 is a front view of the first preferred embodiment of the present invention, showing the desk board being lifted.

As shown in FIG. 5 and FIG. 6, the first motor 62 may turns the first gear member 54 through the first driving gear 60 so as to move the first linkage set 52. The same as above, the second motor 82 may turns the second gear member 74 through the second driving gear 80 so as to move the second linkage set 72.

When the first gear member 54 is moved by the first driving gear 60 to have the end of the main linkage connected to the first gear member 54 moving downward (the support linkages will be moved accordingly), the first movable member 58 is moved upwards (toward the first rail 56). At the same time, the second gear member 74 is moved by the second driving gear 80 to have the end of the main linkage connected to the second gear member 74 moving downwards (the support linkages will be moved accordingly) to move the second movable member 78 upwards (toward the second rail 76). As a result, the desk board 40 is lifted. On the contrary, when the first and the second gear member 54, 74 are moved in revise directions to have the end of the main linkage and the support moving upwards, the first and the second movable members 58, 78 are moved downwards (away from the first and the second rails 56, 76) to lower the desk board 40.

In order to keep the first and the second motors 62, 82 are running synchronous, a controller (not shown) is provided to start and stop the first and the second motors 62, 82 and to synchronize them.

Figure 7:
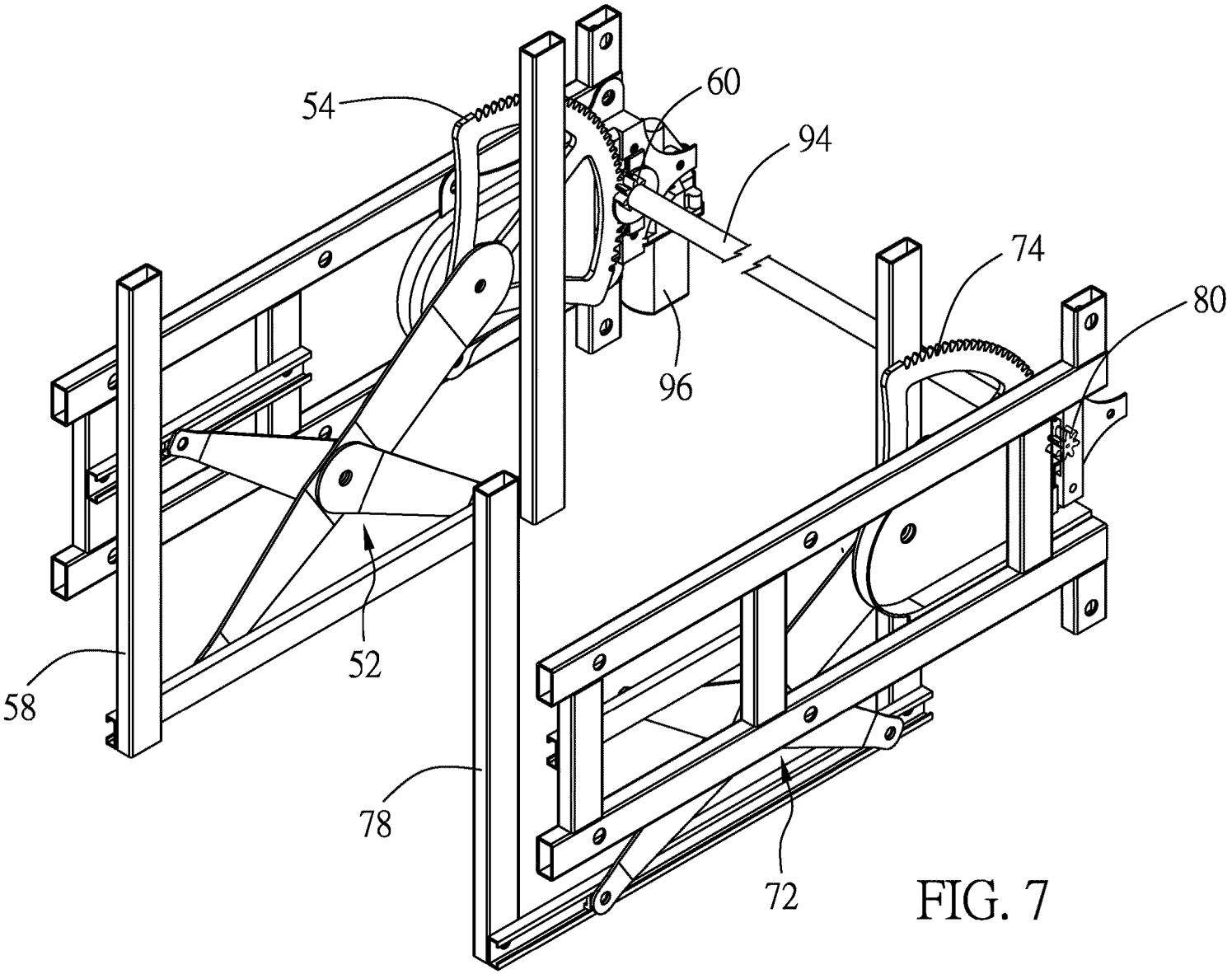
FIG. 7 is a perspective view of a second preferred embodiment of the present invention, showing the first and the second lifting mechanisms.
Figure 8:
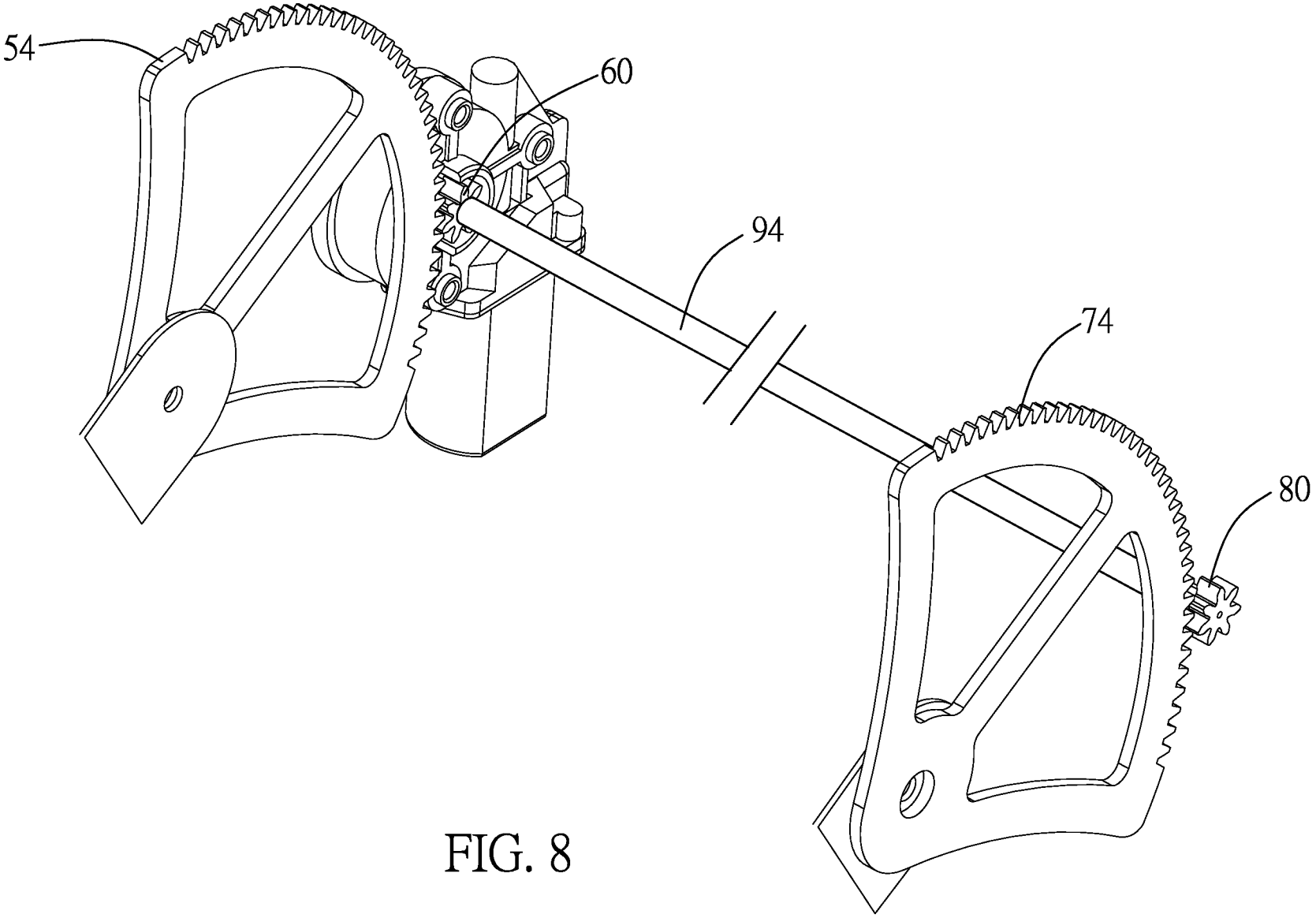
FIG. 8 is a perspective of the second preferred embodiment of the present invention, showing the transmission shaft and the gears.

FIG. 7 and FIG. 8 show a workstation of the second preferred embodiment of the present invention, which is similar to the first preferred embodiment, except that the workstation of the second preferred embodiment includes a transmission shaft 94 and only one motor 96. The first and the second driving gears 60, 80 are connected to opposite ends of the transmission shaft 94. The motor 96 is connected to the transmission shaft 94, so that the first and the second driving gears 60, 80 will be synchronously driven by the motor 96 through the transmission shaft 94 to ensure that the first linkage set 52 and the second linkage set 72 will be moved synchronously.

In conclusion, the present invention provides the first linkage set 52 and the second linkage set 72 to lift and lower the desk board 40 to any height. In addition, the first and the second movable members 58, 78 could be any shape or form except the form described above.

It must be pointed out that the embodiments described above are only some preferred embodiments of the present invention. All equivalent structures which employ the concepts disclosed in this specification and the appended claims should fall within the scope of the present invention.

What is claimed is:

1. A workstation, comprising:

a front partition member having a first end and a second end opposite to the first end;

a first wall member connected to the first end of the front partition member and a second wall member connected to the second end of the front partition member to enclose a workspace;

a desk board provided in the workspace;

a first lifting mechanism fixed to the first wall member and connected to the desk board; and a second lifting mechanism fixed to the second wall member and connected to the desk board;

wherein the first lifting mechanism and the second lifting mechanism are moved to lift and lower the desk board;

wherein the first lifting mechanism includes a first linkage set, a first gear member, a first rail, and a first movable member; the first rail is fixed to the first wall member; the first linkage set includes a main linkage and two support linkages, wherein each of the support linkages has an end pivoted on the main linkage; an end of one of the support linkages movably engages the first rail, and an end of the other one of the support linkages movably engages the first movable member; an end of the main linkage is connected to the first gear member, and an opposite end of the main linkage movably engages the first movable member; the first movable member is connected to the desk board, so that a movement of the first linkage set moves the first movable member to lift and lower the desk board.

2. The workstation of claim 1, wherein the first movable member is provided with a first guiding rail; the main linkage and the support linkage are provided with a slider respectively, and the sliders of the main linkage and the support linkage slidably engage the first guiding rail.

3. The workstation of claim 1, wherein the first lifting mechanism further includes a first frame fixed to the first wall member, and the first rail is fixed to the first frame.

4. The workstation of claim 1, wherein at least one of the first wall member and the second wall member is a board.

5. A workstation, comprising:

a front partition member having a first end and a second end opposite to the first end;

a first wall member connected to the first end of the front partition member and a second wall member connected to the second end of the front partition member to enclose a workspace;

a desk board provided in the workspace;

a first lifting mechanism fixed to the first wall member and connected to the desk board; and a second lifting mechanism fixed to the second wall member and connected to the desk board;

wherein the first lifting mechanism and the second lifting mechanism are moved to lift and lower the desk board;

wherein the second lifting mechanism includes a second linkage set, a second gear member, a second rail, and a second movable member; the second rail is fixed to the second wall member; the second linkage set includes a main linkage and two support linkages, wherein each of the support linkages has an end pivoted on the main linkage; an end of one of the support linkages movably engages the second rail, and an end of the other one of the support linkages movably engages the second movable member; an end of the main linkage is connected to the second gear member, and an opposite end of the main linkage movably engages the second movable member; the second movable member is connected to the desk board, so that a movement of the second linkage set moves the second movable member to lift and lower the desk board.

6. The workstation of claim 5, wherein the second movable member is provided with a second guiding rail; the main linkage and the support linkage are provided with a slider respectively, and the sliders of the main linkage and the support linkage slidably engage the second guiding rail.

7. The workstation of claim 5, wherein the second lifting mechanism further includes a second frame fixed to the second wall member, and the second rail is fixed to the second frame.

8. A workstation, comprising:

a front partition member having a first end and a second end opposite to the first end;

a first wall member connected to the first end of the front partition member and a second wall member connected to the second end of the front partition member to enclose a workspace;

a desk board provided in the workspace;

a first lifting mechanism fixed to the first wall member and connected to the desk board; and a second lifting mechanism fixed to the second wall member and connected to the desk board;

wherein the first lifting mechanism and the second lifting mechanism are moved to lift and lower the desk board;

wherein the first lifting mechanism includes a first linkage set, a first gear member, a first rail, a first movable member, a first driving gear, and a first motor; the first rail is fixed to the first wall member; the first linkage set includes a main linkage and two support linkages, wherein each of the support linkages has an end pivoted on the main linkage; an end of one of the support linkages movably engages the first rail, and an end of the other one of the support linkages movably engages the first movable member; an end of the main linkage is connected to the first gear member, and an opposite end of the main linkage movably engages the first movable member; the first movable member is connected to the desk board; the first driving gear is connected to the first motor and engages the first gear member; further wherein the second lifting mechanism includes a second linkage set, a second gear member, a second rail, a second movable member, a second driving gear, and a second motor; the second rail is fixed to the second wall member; the second linkage set includes a main linkage and two support linkages, wherein each of the support linkages has an end pivoted on the main linkage; an end of one of the support linkages movably engages the second rail, and an end of the other one of the support linkages movably engages the second movable member; an end of the main linkage is connected to the second gear member, and an opposite end of the main linkage movably engages the second movable member; the second movable member is connected to the desk board; the second driving gear is connected to the second motor and engages the second gear member, so that the first linkage set and the second linkage set are driven by the first and the second motors respectively to lift and lower the desk board.

9. A workstation, comprising:

a front partition member having a first end and a second end opposite to the first end;

a first wall member connected to the first end of the front partition member and a second wall member connected to the second end of the front partition member to enclose a workspace;

a desk board provided in the workspace;

a first lifting mechanism fixed to the first wall member and connected to the desk board;

a second lifting mechanism fixed to the second wall member and connected to the desk board;

wherein the first lifting mechanism and the second lifting mechanism are moved to lift and lower the desk board; and a transmission shaft and a motor, wherein the first lifting mechanism includes a first linkage set, a first gear member, a first rail, a first movable member, and a first driving gear; the first rail is fixed to the first wall member; the first linkage set includes a main linkage and two support linkages, wherein each of the support linkages has an end pivoted on the main linkage; an end of one of the support linkages movably engages the first rail, and an end of the other one of the support linkages movably engages the first movable member; an end of the main linkage is connected to the first gear member, and an opposite end of the main linkage movably engages the first movable member; the first movable member is connected to the desk board; the first driving gear engages the first gear member; further wherein the second lifting mechanism includes a second linkage set, a second gear member, a second rail, a second movable member, and a second driving gear; the second rail is fixed to the second wall member; the second linkage set includes a main linkage and two support linkages, wherein each of the support linkages has an end pivoted on the main linkage; an end of one of the support linkages movably engages the second rail, and an end of the other one of the support linkages movably engages the second movable member; an end of the main linkage is connected to the second gear member, and an opposite end of the main linkage movably engages the second movable member; the second movable member is connected to the desk board; the second driving gear engages the second gear member; the first driving gear and the second driving gear are connected to the transmission shaft, and the motor is connected to the transmission shaft to drive the transmission shaft to turn, so that motor moves the first linkage set and the second linkage set through the transmission shaft and the first and the second driving gears to lift and lower the desk board.

* * * * *